US010472037B2

(12) United States Patent
Park et al.

(10) Patent No.: US 10,472,037 B2
(45) Date of Patent: Nov. 12, 2019

(54) METHOD OF DECREASING PRESSURE FLUCTUATION ON HULL OF TWIN-PROPELLER SHIP BY ADJUSTING ROTATION ANGLES OF TWO PROPELLERS

(71) Applicant: Korea Institute of Ocean Science & Technology, Ansan (KR)

(72) Inventors: Cheol Soo Park, Daejeon (KR); Gun Do Kim, Daejeon (KR); Youngha Park, Daejeon (KR)

(73) Assignee: KOREA INSTITUTE OF OCEAN SCIENCE & TECHNOLOGY, Ansan (KR)

( * ) Notice: Subject to any disclaimer, the term of this patent is extended or adjusted under 35 U.S.C. 154(b) by 160 days.

(21) Appl. No.: 15/641,109

(22) Filed: Jul. 3, 2017

(65) Prior Publication Data

US 2018/0170497 A1 Jun. 21, 2018

(30) Foreign Application Priority Data

Dec. 19, 2016 (KR) ..... 10-2016-0173687

(51) Int. Cl.

| | |
|---|---|
| ***B60L 3/00*** | (2019.01) |
| ***B63H 5/125*** | (2006.01) |
| ***B63J 99/00*** | (2009.01) |
| *B63H 5/08* | (2006.01) |
| *B63H 1/18* | (2006.01) |

(52) U.S. Cl.

CPC ..... *B63H 5/125* (2013.01); *B63J 99/00* (2013.01); *B63H 1/18* (2013.01); *B63H 5/08* (2013.01); *B63J 2099/006* (2013.01)

(58) Field of Classification Search

CPC . B63H 5/125; B63H 1/28; B63H 5/08; B63H 1/18; B63J 99/00; B63J 2099/006

USPC ..... 701/21; 440/66, 79, 83, 75, 95, 49; 180/65.265

See application file for complete search history.

(56) References Cited

U.S. PATENT DOCUMENTS

| | | | | |
|---|---|---|---|---|
| 3,463,115 | A * | 8/1969 | French | B63H 21/16 440/3 |
| 5,295,641 | A * | 3/1994 | Kaptein | G10K 11/175 181/206 |
| 6,066,012 | A * | 5/2000 | Nagle | B63H 23/06 440/75 |
| 2001/0051475 | A1* | 12/2001 | Reuter | B63H 5/10 440/66 |
| 2004/0147182 | A1* | 7/2004 | Reuter | B63H 5/08 440/66 |
| 2005/0079776 | A1* | 4/2005 | Miller | B63H 1/34 440/95 |
| 2006/0057910 | A1* | 3/2006 | Stallings | B63H 20/08 440/79 |
| 2006/0089062 | A1* | 4/2006 | Carr | B63H 23/06 440/75 |
| 2006/0166567 | A1* | 7/2006 | Otobe | B63H 21/265 440/1 |

(Continued)

FOREIGN PATENT DOCUMENTS

| | | | | |
|---|---|---|---|---|
| WO | WO-2012014989 A1 * | 2/2012 | | B63H 1/18 |
| WO | WO-2013113681 A1 * | 8/2013 | | B63H 1/18 |

*Primary Examiner* — Shardul D Patel

(57) ABSTRACT

Disclosed is a method of decreasing pressure fluctuation induced on a surface of a hull due to propeller cavitation by adjusting a relative rotation angle of propellers of a twin-propeller ship.

5 Claims, 6 Drawing Sheets

(56) References Cited

U.S. PATENT DOCUMENTS

| | | | | |
|---|---|---|---|---|
| 2012/0101671 | A1* | 4/2012 | Caouette | B63H 21/17<br>701/21 |
| 2014/0156124 | A1* | 6/2014 | Hara | B63H 25/42<br>701/21 |
| 2014/0174331 | A1* | 6/2014 | Hitachi | B63H 25/42<br>114/144 R |
| 2014/0230715 | A1* | 8/2014 | Kim | B63B 1/38<br>114/67 A |

* cited by examiner

METHOD OF DECREASING PRESSURE FLUCTUATION ON HULL OF TWIN-PROPELLER SHIP BY ADJUSTING ROTATION ANGLES OF TWO PROPELLERS

CROSS REFERENCE TO RELATED APPLICATION

The present application claims priority to Korean Patent Application No. 10-2016-0173687, filed Dec. 19, 2016, the entire contents of which is incorporated herein for all purposes by this reference.

BACKGROUND OF THE INVENTION

Field of the Invention

The present invention relates generally to a method of decreasing pressure fluctuation on a hull of a twin-propeller ship by adjusting rotation angles of two propellers.

Description of the Related Art

Pressure fluctuation means pressure change induced on a surface of a hull by cavitation that occurs when propellers rotate.

Generation amount of cavitation that occurs due to a blade of a propeller varies according to a rotation angle due to uneven wake of the hull as shown in FIG. 1.

FIG. 1 is a view illustrating condition of general cavitation that occurs due to a blade of a propeller. The left of FIG. 1 illustrates a shape and a reference angle of the propeller viewed from behind of a ship, and the right of FIG. 1 illustrates an example of calculating an occurrence pattern of cavitation depending on a blade angle of the propeller.

FIG. 2 is a view illustrating an example of calculating a pressure fluctuation-time history caused by occurrence of cavitation in FIG. 1.

FIG. 2 illustrates four, which is the number of blades of the propeller, cyclical pressure fluctuations when a propeller makes one revolution.

Here, the size and the phase in the pressure fluctuation-time history vary depending on a relative distance between the propeller and a location on the hull.

Accordingly, pressure fluctuation has a difference size and phase at several locations on the hull.

Pressure fluctuation is a major cause of vibration and noise in a ship. When the pressure fluctuation is large, the vibration and noise of the ship may be large in proportion thereto.

This applies to a ship operated by twin propellers, namely, a twin-propeller ship.

Particularly, in the twin-propeller ship, each of the two propellers (left and right) causes pressure fluctuation. Thus, total pressure fluctuation which is a combination thereof may be much larger than that of an ordinary ship, and the overall process may be more complicated.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and the present invention is intended to propose a method of decreasing pressure fluctuation on a hull of a twin-propeller ship by adjusting a relative rotation angle of two propellers, pressure fluctuation being induced on a surface of the hull due to propeller cavitation.

In order to achieve the above object, according to one aspect of the present invention, there is provided a method of decreasing pressure fluctuation on a hull of a twin-propeller ship by adjusting rotation angles of two propellers, the method including: adjusting a phase difference in a pressure fluctuation-time history so as to decrease total pressure fluctuation induced by the two propellers of the twin-propeller ship, wherein the adjusting of the phase difference in the pressure fluctuation-time history is performed by adjusting a relative rotation angle of the two propellers.

According to another aspect of the present invention, there is provided a method of decreasing pressure fluctuation on a hull of a twin-propeller ship by adjusting rotation angles of two propellers, the method including: calculating, by an optimum-phase calculator at step S1, an optimum relative rotation angle according to sailing condition of the ship, and outputting information on the calculated optimum relative rotation angle to a controller; collecting, by encoders respectively provided to shafts at step S2, information on RPM and a rotation angle of each of the two propellers, and outputting the collected information to the controller; calculating, by the controller at step S3, a relative rotation angle of the two propellers, and comparing the relative rotation angle with the optimum relative rotation angle, the controller outputting a control command to a propeller phase control system to tune the relative rotation angle to the optimum relative rotation angle; and controlling, by the propeller phase control system at step S4, the relative rotation angle of the two propellers to be tuned to the optimum relative rotation angle in compliance with the control command from the controller.

At the step S1, the optimum-phase calculator may calculate the optimum relative rotation angle through cavitation flow analysis and pressure fluctuation analysis.

At the step S1, the optimum-phase calculator may calculate the optimum relative rotation angle in real-time. Alternatively, the optimum-phase calculator may calculate the optimum relative rotation angle in advance according to predictive sailing condition of the ship, and store the calculated optimum relative rotation angle to be referenced.

At the step S4, the propeller phase control system gradually may increase or decrease the RPM of one of the two propellers so as to tune the relative rotation angle to the optimum relative rotation angle.

According to the present invention, rotation states of the propellers can be maintained in the optimum state by adjusting the rotation angles of the propellers of a twin-propeller ship, whereby pressure fluctuation can be effectively decreased in real-time according to the sailing condition of the ship.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinbelow, exemplary embodiments of the present invention will be described in detail with reference to the accompanying drawings.

Figure 1:
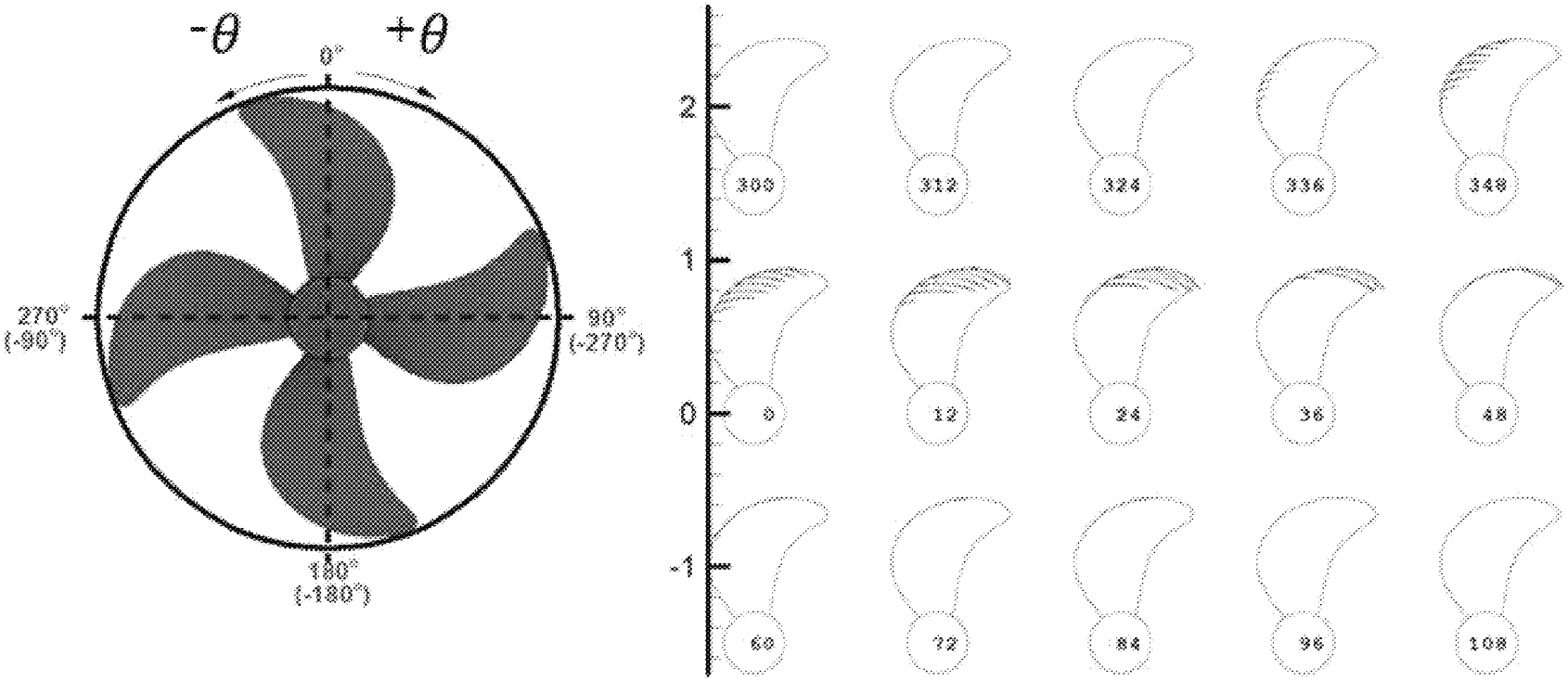
FIG. 1 is a view illustrating condition of general cavitation that occurs due to a blade of a propeller.
Figure 2:
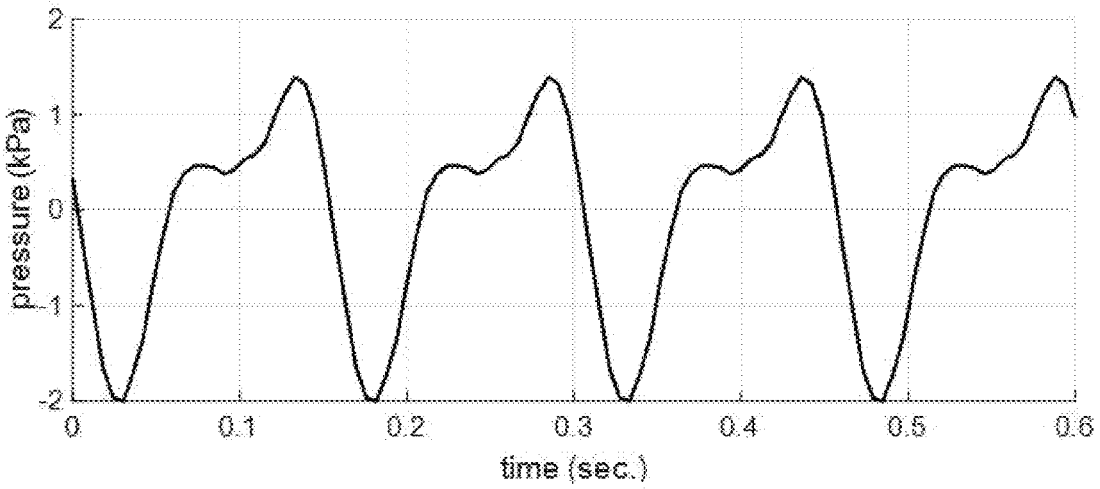
FIG. 2 is a view illustrating an example of calculating a pressure fluctuation-time history caused by the occurrence of cavitation in FIG. 1.
Figure 3:
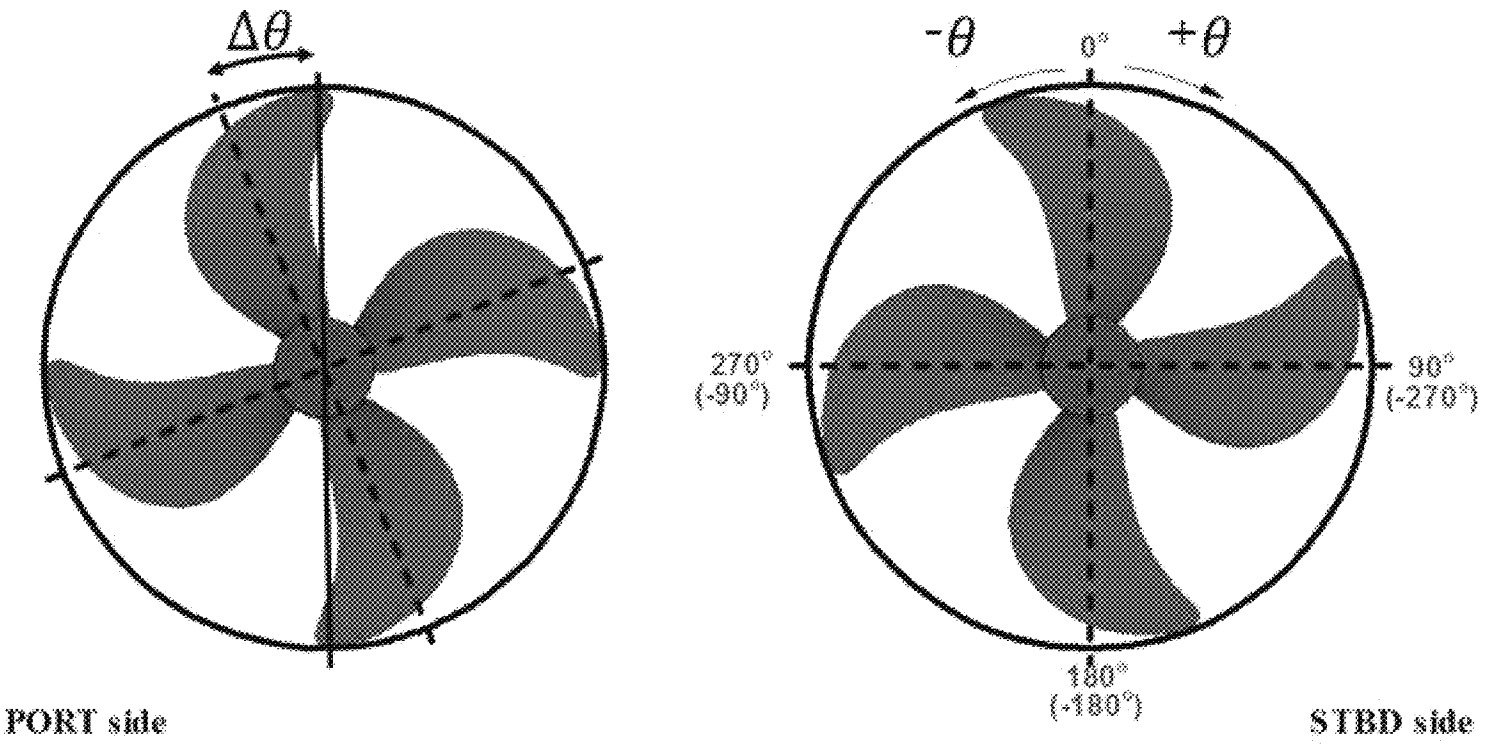
FIG. 3 is a view illustrating a shape and a reference angle of a propeller viewed from behind a twin-propeller ship.

FIG. 3 is a view illustrating a shape and a reference angle of a propeller viewed from behind a twin-propeller ship.

Generally, in the twin-propeller ship, two (left and right) propellers have the same blade shape and the same RPM, but opposite rotation directions.

Therefore, fundamentally, two propellers have similar occurrence patterns of cavitation.

However, in a pressure fluctuation-time history induced by each propeller at a particular location on the hull, the size and the phase vary depending on a relative distance between the propeller and a location on the hull.

In this case, when phases induced by the two propellers are coincidentally the same in a pressure fluctuation-time history, total pressure fluctuation may be maximized due to constructive interference. In contrast, when the phases are opposite to each other, the total pressure fluctuation may be minimized due to destructive interference.

In a twin-propeller ship, total pressure fluctuation can be decreased by discretionarily adjusting a phase difference in a pressure fluctuation-time history induced by the two propellers. The prevent invention is intended to propose a method of decreasing pressure fluctuation for a twin-propeller ship by utilizing such a technical principle.

According to the present invention, the adjusting of the phase difference in the pressure fluctuation-time history may be performed by adjusting a relative rotation angle (A of FIG. 3) of the two propellers.

Here, the relative rotation angle means a rotation angle difference between the two propellers.

Figure 4:
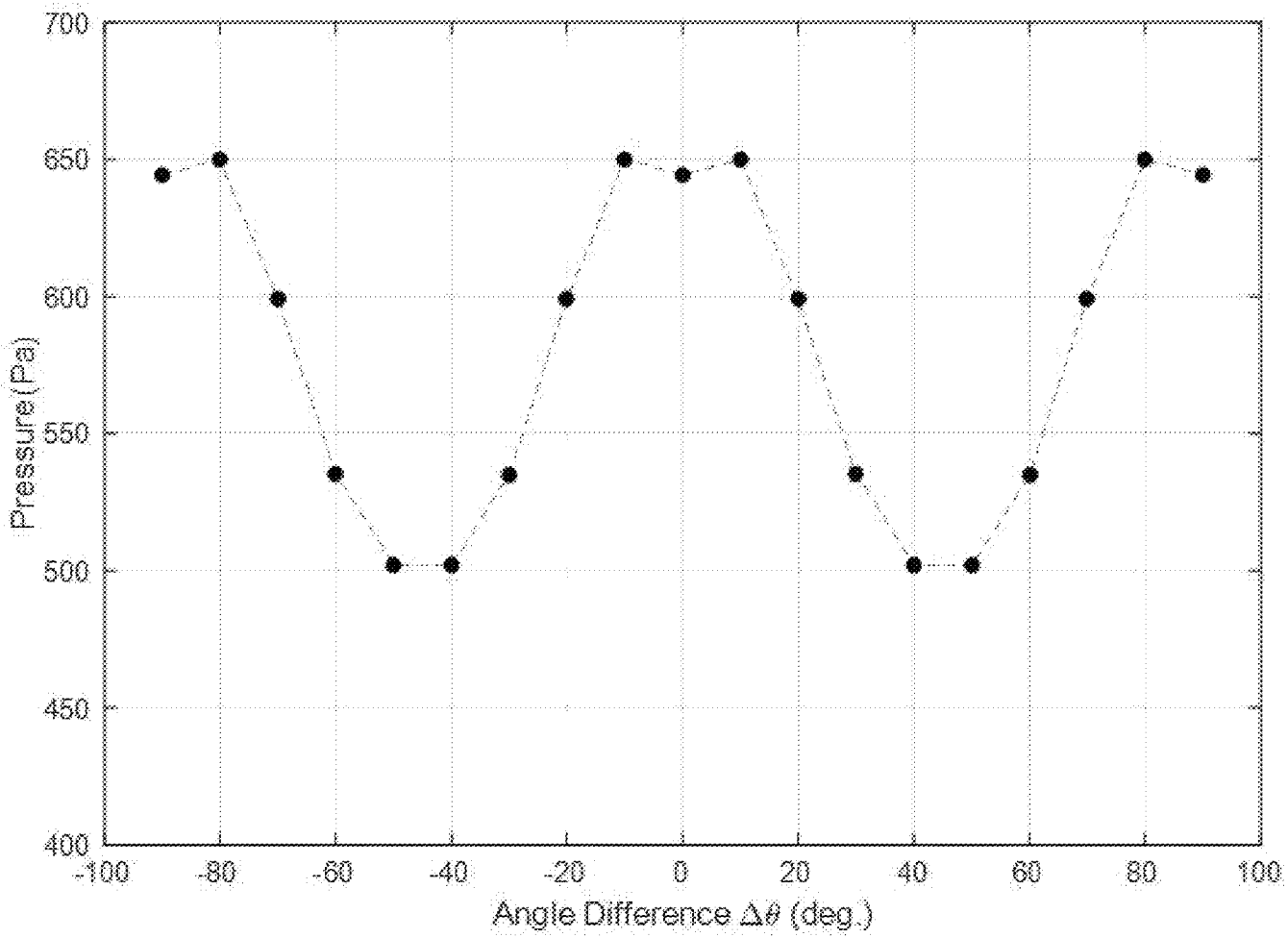
FIG. 4 is a view illustrating an example of calculating change in a size of pressure fluctuation in consequence of change in a relative rotation angle in FIG. 3.

FIG. 4 is a view illustrating an example of calculating change in a size of pressure fluctuation in consequence of change in a relative rotation angle in FIG. 3.

In FIG. 4, when the relative rotation angle of the two propellers is in a range of 40 to 50 degree angles, pressure fluctuation may be decreased by about 25%, compared to a relative rotation angle at zero degree angle.

FIG. 4 is just an example, and thus twin-propeller ships may have different relative rotation angles for minimizing pressure fluctuation.

In the present invention, the relative rotation angle for minimizing pressure fluctuation is called 'an optimum relative rotation angle.'

Hereinafter, a process of decreasing pressure fluctuation of the twin-propeller ship will be disclosed step by step in detail according to the present invention.

Figure 5:
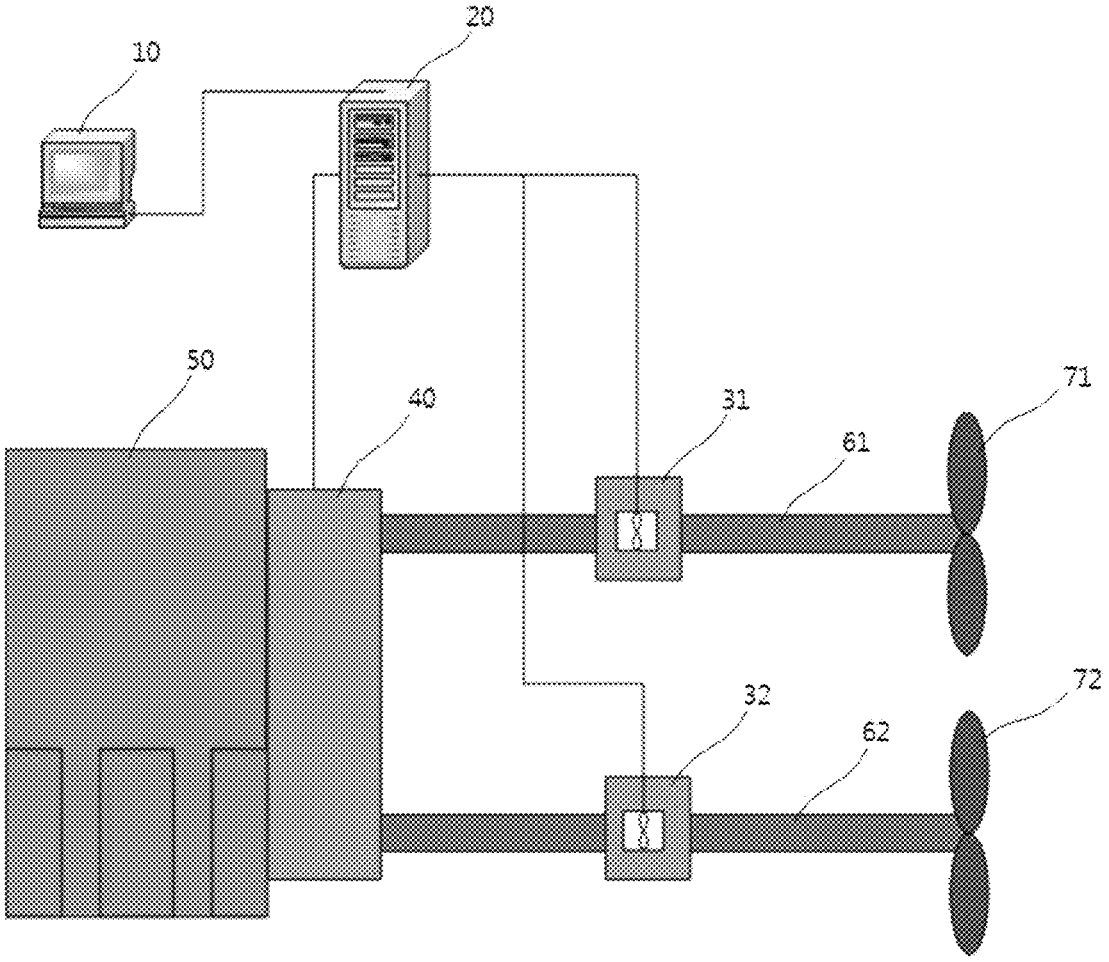
FIG. 5 is a view illustrating configuration of a system for realizing the present invention.
Figure 6:
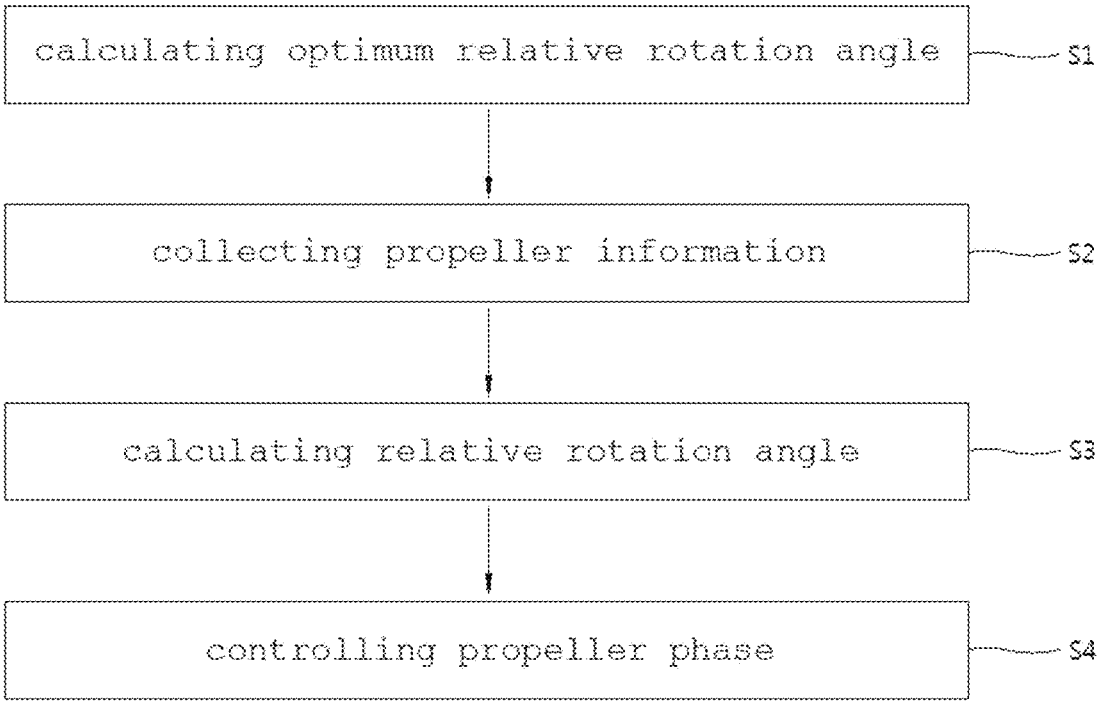
FIG. 6 is a view illustrating steps in a process for realizing the present invention.

FIG. 5 is a view illustrating configuration of a system for realizing the present invention, and FIG. 6 is a view illustrating steps in a process for realizing the present invention.

A system according to the present invention may include an optimum phase calculator 10, a controller 20, encoders 31 and 32, and a propeller phase control system 40. The encoders 31 and 32 are respectively provided to shafts 61 and 62.

S1: Calculating of an Optimum Relative Rotation Angle

First, the optimum phase calculator 10 calculates an optimum relative rotation angle according to sailing condition of the ship.

In this case, the optimum phase calculator 10 calculates the optimum relative rotation angle through cavitation flow analysis and pressure fluctuation analysis.

The optimum phase calculator 10 may calculate the optimum relative rotation angle in real-time. Alternatively, the optimum phase calculator 10 may calculate the optimum relative rotation angle in advance according to predictive sailing condition of the ship, and may store the result to refer to the stored result as needed.

The optimum phase calculator 10 outputs information on the calculated optimum relative rotation angle to the controller 20.

S2: Collecting of Propeller Information

The encoders 31 and 32 respectively provided to the shafts 61 and 62 collect information on the RPM and the rotation angle of the propellers 71 and 72, and provide the collected information to the controller 20.

S3: Calculating of a Relative Rotation Angle

The controller 20 calculates the relative rotation angle of two propellers 71 and 72.

The controller 20 compares the relative rotation angle with the optimum relative rotation angle. When there is a difference between the relative rotation angle and the optimum relative rotation angle, the controller 20 outputs a control command to the propeller phase control system 40 to tune the relative rotation angle to the optimum relative rotation angle.

When the relative rotation angle and the optimum relative rotation angle are the same, the controller 20 does not output the control command.

S4: Controlling of Propeller Phase

The propeller phase control system 40 controls the relative rotation angle to be tuned to the optimum relative rotation angle of the two propellers 71 and 72 in compliance with the control command from the controller 20.

In this case, the controlling of the relative rotation angle to be tuned to the optimum relative rotation angle may be performed in various manners.

For example, the propeller phase control system 40 gradually increases or decreases RPM of one propeller 71 or 72 of the two propellers 71 and 72, whereby a rotation angle difference between the two propellers 71 and 72, namely, the relative rotation angle can be tuned to the optimum relative rotation angle.

Here, the propeller phase control system 40 receives information on the RPM of the propellers 71 and 72 from the controller 20, and controls an engine system 50 coupled to the propellers 71 and 72 so as to adjust RPM of the propellers 71 and 72.

By repeating steps S2 to S4, the rotation states of the propellers 71 and 72 can be maintained in the optimum state, whereby pressure fluctuation of the twin-propeller ship can be effectively decreased according to sailing condition of the ship in real-time.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A method of decreasing pressure fluctuation due to cavitation on a hull of a twin-propeller ship by adjusting a relative rotation angle between two propellers, the method comprising:

adjusting a phase difference in a pressure fluctuation-time history so as to decrease total pressure fluctuation due to cavitation induced by the two propellers of the twin-propeller ship on the hull of the ship, wherein the adjusting of the phase difference in the pressure fluctuation-time history is performed by adjusting the relative rotation angle between the two propellers so that the total pressure fluctuation due to cavitation is decreased by destructive interference between the pressure fluctuation associated with each of the two propellers.

2. A method of decreasing pressure fluctuation due to cavitation on a hull of a twin-propeller ship by adjusting a relative rotation angle between the two propellers, the method comprising:

calculating, by an optimum-phase calculator at step S1, an optimum relative rotation angle between the two propellers such that the total pressure fluctuation due to cavitation is decreased by destructive interference between the pressure fluctuation associated with each of the two propellers, and outputting information on the calculated optimum relative rotation angle to a controller;

collecting, by encoders respectively provided to shafts at step S2, information on rotations per minute (RPM) and a rotation angle of each of the two propellers, and outputting the collected information to the controller;

calculating, by the controller at step S3, a relative rotation angle between the two propellers, and comparing the relative rotation angle with the optimum relative rotation angle, the controller outputting a control command to a propeller phase control system to tune the relative rotation angle to the optimum relative rotation angle; and controlling, by the propeller phase control system at step S4, the relative rotation angle of the two propellers to be tuned to the optimum relative rotation angle in compliance with the control command from the controller.

3. The method of claim 2, wherein at the step S1, the optimum-phase calculator calculates the optimum relative rotation angle through cavitation flow analysis and pressure fluctuation analysis.

4. The method of claim 2, wherein at the step S1, the optimum-phase calculator calculates the optimum relative rotation angle in real-time, or the optimum-phase calculator calculates the optimum relative rotation angle in advance according to predictive sailing condition of the ship, and stores the calculated optimum relative rotation angle to be referenced.

5. The method of claim 2, wherein at the step S4, the propeller phase control system gradually increases or decreases the RPM of one of the two propellers so as to tune the relative rotation angle to the optimum relative rotation angle.

* * * * *